US009018149B2

(12) United States Patent
Farng et al.

(10) Patent No.: US 9,018,149 B2
(45) Date of Patent: Apr. 28, 2015

(54) METHOD FOR REDUCING ONE OR MORE OF DEPOSITS AND FRICTION OF A LUBRICATING OIL

(75) Inventors: L. Oscar Farng, Lawrenceville, NJ (US); Douglas E. Deckman, Mullica Hill, NJ (US); Andrew G. Horodysky, Cherry Hill, NJ (US); William H. Buck, West Chester, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 49 days.

(21) Appl. No.: 13/105,376

(22) Filed: May 11, 2011

(65) Prior Publication Data

US 2011/0287990 A1 Nov. 24, 2011

Related U.S. Application Data

(60) Provisional application No. 61/333,937, filed on May 12, 2010.

(51) Int. Cl.

| | |
|---|---|
| ***C10M 163/00*** | (2006.01) |
| ***C10M 141/12*** | (2006.01) |
| *C10M 141/02* | (2006.01) |
| *C10M 129/95* | (2006.01) |
| *C10M 141/06* | (2006.01) |

(Continued)

(52) U.S. Cl.

CPC ..... *C10M 163/00* (2013.01); *C10M 141/02* (2013.01); *C10M 2201/087* (2013.01); *C10M 129/95* (2013.01); *C10M 141/06* (2013.01); *C10M 133/16* (2013.01); *C10M 2215/026* (2013.01); *C10M 2227/00* (2013.01); *C10M 129/04* (2013.01); *C10M 2290/00* (2013.01); *C10M 2207/028* (2013.01); *C10M 2215/28* (2013.01); *C10M 129/74* (2013.01); *C10M 2207/02* (2013.01); *C10M 129/68* (2013.01); *C10M 139/00* (2013.01); *C10M 133/14* (2013.01); *C10M 129/08* (2013.01); *C10M 2207/022* (2013.01); *C10M 141/12* (2013.01); *C10M 2207/283* (2013.01); *C10M 2215/082* (2013.01); *C10M 2227/061* (2013.01); *C10N 2230/04* (2013.01); *C10N 2230/06* (2013.01); *C10N 2230/42* (2013.01); *C10N 2240/10* (2013.01)

(58) Field of Classification Search

USPC ..... 508/454

See application file for complete search history.

(56) References Cited

U.S. PATENT DOCUMENTS

| | | | | |
|---|---|---|---|---|
| 6,855,675 | B1 | 2/2005 | Yamada et al. | |
| 2004/0138073 | A1 * | 7/2004 | Karol et al. | 508/195 |

(Continued)

*Primary Examiner* — Taiwo Oladapo

(74) *Attorney, Agent, or Firm* — Robert A. Migliorini

(57) ABSTRACT

The present invention is directed to a method for improving one or more of the control of deposit formation and friction in an engine lubricated using a lubricating oil comprising a base oil and additives by employing as the additive the necessary combination of a borated hydroxyl saturated hydrocarbyl ester amide-amine mixture, zinc dialkyl dithiophosphate, and metal salicylate detergent, the deposit formation and friction being improved as compared to a lubricating oil containing the borated hydroxyl saturated hydrocarbyl ester amide-amine mixture, zinc dialkyl dithiophosphate and a detergent other than metal salicylate, such as metal phosphate and/or metal sulfonate.

9 Claims, 1 Drawing Sheet

(51) Int. Cl.

| | |
|---|---|
| *C10M 133/16* | (2006.01) |
| *C10M 129/04* | (2006.01) |
| *C10M 129/74* | (2006.01) |
| *C10M 129/68* | (2006.01) |
| *C10M 139/00* | (2006.01) |
| *C10M 133/14* | (2006.01) |
| *C10M 129/08* | (2006.01) |

(56) References Cited

U.S. PATENT DOCUMENTS

| | | | | |
|---|---|---|---|---|
| 2007/0254821 | A1* | 11/2007 | Aguilar et al. | 508/555 |
| 2008/0221000 | A1* | 9/2008 | Chase et al. | 508/262 |

* cited by examiner

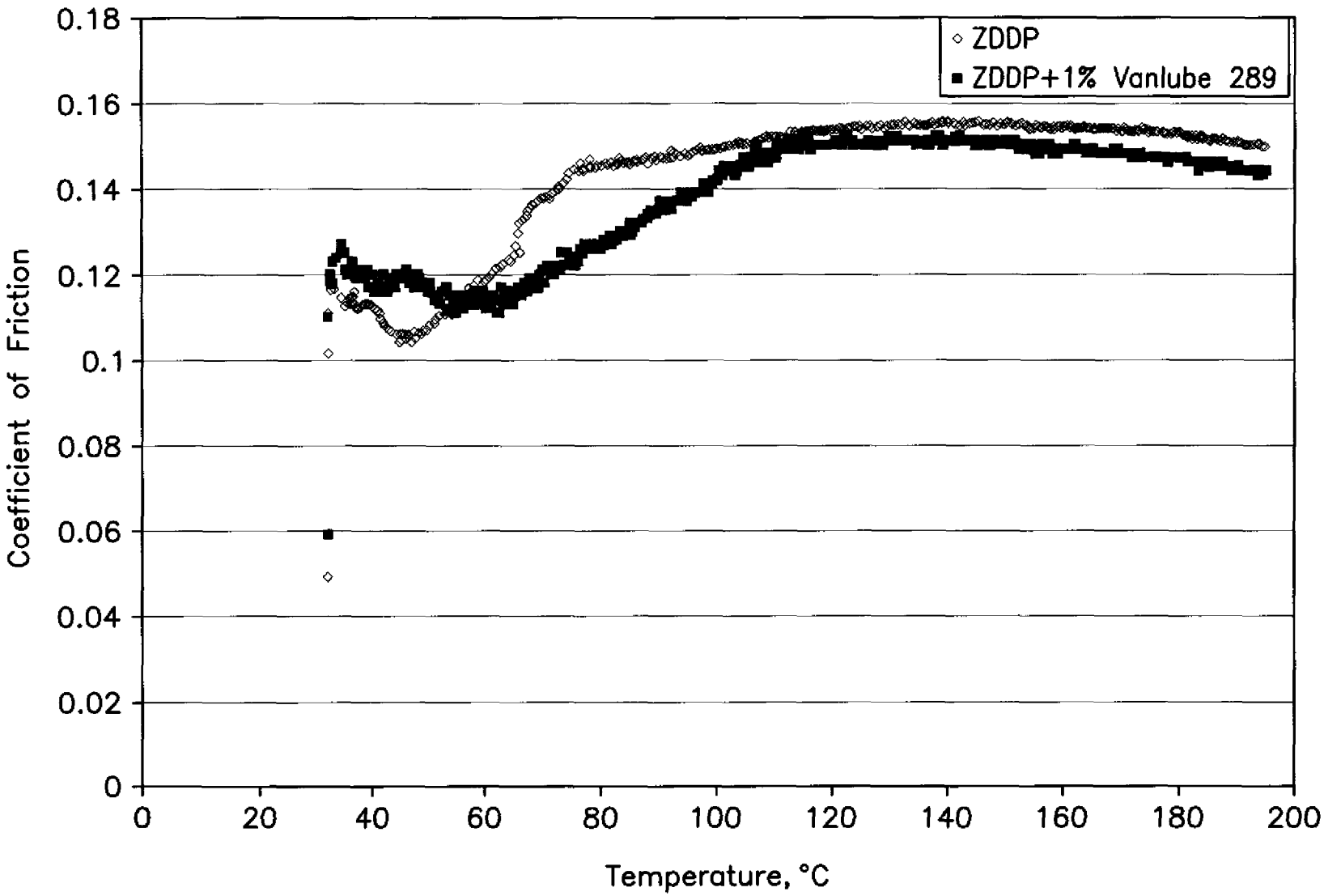
ZDDP
ZDDP+1% Vanlube 289
Coefficient of Friction
0.18
0.16
0.14
0.12
0.1
0.08
0.06
0.04
0.02
0
0
20
40
60
80
100
120
140
160
180
200
Temperature, °C

METHOD FOR REDUCING ONE OR MORE OF DEPOSITS AND FRICTION OF A LUBRICATING OIL

This application claims benefit of U.S. Provisional Application 61/333,937 filed May 12, 2010.

BACKGROUND OF THE INVENTION

1. Field of the Invention

The present invention relates to lubricating engines using formulated lubricating oils to reduce deposit formation and friction in the engine.

2. Description of the Related Art

Engine oils are formulated for the purpose of reducing friction in the engine, engine cleanliness, e.g. deposit control, control of wear, corrosion and rust in the engine. To accomplish this goal the engine oil contains numerous and various additives including friction reducers, detergents, dispersants, extreme pressure additives, viscosity index improvers, and oxidants.

Of significant concern is the reduction of friction in engines so as to improve fuel economy necessitating the use of lower viscosity lubricating oil base stocks while also meeting the competing requirements of maintaining sufficiently high lubricating oil film thickness at high operating temperature to avoid incidental breakdown of the oil film under boundary conditions while still maintaining low wear over a wide range of temperatures.

The principal anti-wear additive for engine oils has been and is zinc dialkyl dithiophosphate (ZDDP); however, while ZDDP is typically used in the lubricating oil at a sufficient concentration to provide a phosphorus content of 0.08 wt % or more to pass industry standard tests for anti-wear performance, such high phosphorus content in the oil can result in deactivation of emission control catalysts used in automotive exhaust systems if and when engine oil migrates into the combustion chamber and is burned and becomes part of the exhaust gases. Thus, it is desirable to reduce the amount of phosphorus containing additive in the lubricating oil.

WO 2007/127836 is directed to a molybdenum-free lubricating composition comprising an anti-oxidant additive composition based on a combination of (1) alkylated diphenyl amine; (2) a polyamine dispersant; and (3) a concentration of monoglyceride and ethoxylated amide. Preferably the monoglyceride ethoxylated amide combination is borated which permits a reduction in the phosphorus levels in the lubricating oil to below 0.08 wt %, or even phosphorus free. Preferably the borated monoglyceride ethoxylated amide is Vanlube® 289. Other additives may be present including detergents such as the generally disclosed sulfonates, phenates and salicylates, with sulfonates being identified as preferred.

U.S. Application 2004/0138073 is directed to an additive for imparting anti-wear properties to a lubricant. The additive is based on a combination of an organoborate ester composition and one or more sulfur- or phosphorus-containing compounds or a non-sulfur molybdenum compound. The additives which are said to show a synergistic effect in combination with the borate ester composition include dithiophosphates such as ZDDP. The preferred borated ester composition is the reaction product obtained by reacting 1 mole fatty oil with about 1.0 to 2.5 moles diethanolamine followed by subsequent reaction with boric acid. The formulation of the references can contain detergents including metal salts of sulfonates, carboxylates, phenates and salicylates with preferred detergent being overbased organic salts of sulfonates.

DESCRIPTION OF THE FIGURE

FIG. 1 compares the coefficient of friction versus temperature for a formulation containing only ZDDP against a formulation of the invention containing ZDDP and 1% Vanlube® 289.

DESCRIPTION OF THE INVENTION

The present invention is directed to a method for improving one or more of the deposit formation and friction in an engine lubricated with a lubricating oil by using as the lubricating oil a formulated oil comprising a lubricating oil base stock as a major component and as essential component minor amounts of: (1) a borated hydroxyl saturated hydrocarbyl ester amide-amine mixture; (2) zinc dialkyl dithiophosphate; and (3) alkali and/or alkaline earth metal salicylate detergent whereby the levels of deposit formation and/or friction are improved as compared to the levels achieved using a lubricating oil not containing the borated hydroxyl saturated hydrocarbyl ester amide-amine mixture, zinc dialkyl dithiophosphate and a detergent other than the alkali and/or alkaline earth metal salicylate, e.g. metal phenate or metal sulfonate.

In the method the lubricating oil base oil can be any oil boiling in the lube oil boiling range, typically between about 100 to 450° C. In the present specification and claims the terms base oil(s) and base stock(s) are used interchangeably.

A wide range of lubricating base oils is known in the art. Lubricating base oils are both natural oils and synthetic oils. Natural and synthetic oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as feed stock.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and less than about 90% saturates. Group II base stocks generally have a viscosity index of between about 80 to 120, and contain less than or equal to about 0.03% sulfur and greater than or equal to about 90% saturates. Group III stocks generally have a viscosity index greater than about 120 and contain less than or equal to about 0.03% sulfur and greater than about 90% saturates. Group IV includes polyalphaolefins (PAO). Group V base stock includes base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) and GTL products | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source; for example, as to whether they are paraffinic, naphthenic, or mixed paraffinic-naphthenic. Oils derived from coal or shale are also useful. Natural oils vary also as to the method used for their production and purification; for example, their distillation range and whether they are straight run or cracked, hydrorefined, or solvent extracted.

Group II and/or Group III hydroprocessed or hydrocracked base stocks, as well as synthetic oils such as polyalphaolefins, alkyl aromatics and synthetic esters, i.e. Group IV and Group V oils are also well known base stock oils.

Synthetic oils include hydrocarbon oil such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks, the Group IV API base stocks, are a commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073, which are incorporated herein by reference in their entirety. Group IV oils, that is, the PAO base stocks have viscosity indices preferably greater than 130, more preferably greater than 135, still more preferably greater than 140.

The hydrocarbyl aromatics can be used as base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatics can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{40}$ often being preferred. A mixture of hydrocarbyl groups is often preferred. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols such as the neopentyl polyols; e.g., neopentyl glycol, trimethylol ethane, 2-methyl-2-propyl-1,3-propanediol, trimethylol propane, pentaerythritol and dipentaerythritol with alkanoic acids containing at least about 4 carbon atoms, preferably $C_5$ to $C_{30}$ acids such as saturated straight chain fatty acids including caprylic acid, capric acids, lauric acid, myristic acid, palmitic acid, stearic acid, arachic acid, and behenic acid, or the corresponding branched chain fatty acids or unsaturated fatty acids such as oleic acid, or mixtures of any of these materials.

Non-conventional or unconventional base stocks and/or base oils include one or a mixture of base stock(s) and/or base oil(s) derived from: (1) one or more Gas-to-Liquids (GTL) materials, as well as (2) hydrodewaxed, or hydroisomerized/cat (and/or solvent) dewaxed base stock(s) and/or base oils derived from synthetic wax, natural wax or waxy feeds, mineral and/or non-mineral oil waxy feed stocks such as gas oils, slack waxes (derived from the solvent dewaxing of natural oils, mineral oils or synthetic oils; e.g., Fischer-Tropsch feed stocks), natural waxes, and waxy stocks such as gas oils, waxy fuels hydrocracker bottoms, waxy raffinate, hydrocrackate, thermal crackates, foots oil or other mineral, mineral oil, or even non-petroleum oil derived waxy materials such as waxy materials recovered from coal liquefaction or shale oil, linear or branched hydrocarbyl compounds with carbon number of about 20 or greater, preferably about 30 or greater and mixtures of such base stocks and/or base oils.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3)

hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

Base oils for use in the formulated lubricating oils useful in the present invention are any of the variety of oils corresponding to API Group I, Group II, Group III, Group IV, Group V and Group VI oils and mixtures thereof, preferably API Group II, Group III, Group IV, Group V and Group VI oils and mixtures thereof, more preferably the Group III to Group VI base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The additives of the lubricating oil which result in the control and/or improvement in one or more of deposit formation and friction constitute as essential components:

1) a borated hydroxyl saturated hydrocarbyl ester amide-amine mixture;
2) zinc dialkyl dithiophosphate; and
3) alkali and/or alkaline earth metal salicylate detergent.

An anti-oxidant such as a phenolic, aminic, copper compound, organic sulfide, disulfide or polysulfide can also be present and is preferably present.

The borated hydroxyl saturated hydrocarbyl ester amide-amine mixture comprises the unseparated/unpurified product produced by reacting an ester derived from an aliphatic alcohol or polyhydric alcohol, preferably glycerol, with a saturated fatty acid having 6-24 carbon atoms, preferably 6-18 carbon atoms or less, still more preferably 7-17 carbon atoms, with a basic amine and a borating agent, the mixture containing unreacted starting materials and intermediates. A typical borated hydroxyl saturated hydrocarbyl ester amide-amine mixture can be produced by reacting 1 mole of esterified mono- or polyhydric alcohol, preferably glycerol, the alcohol being esterified with saturated normal or branched, preferably normal, $C_6$-$C_{24}$ fatty acids, with 1 to 3 moles of a basic amine which may be selected from mono- or polyamines or alkoxylated amines of the formula:

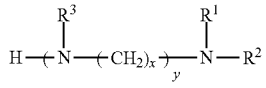

wherein x is an integer ranging from 1 to 10, preferably 1 to 5, more preferably 1 to 2; y is an integer ranging from 0 to 10, preferably 0 to 5, more preferably 0 to 2; $R^1$, $R^2$ and $R^3$ are the same or different and are selected from H, $C_1$ to $C_{30}$ alkyl, $-(C_2H_4—C_6H_{4-12})OH$, provided at least one of $R^1$, $R^2$ and $R^3$ is not hydrogen, preferably H, $C_1$ to $C_{10}$ alkyl, $-(C_2H_4—C_6H_{4-10})OH$, provided at least one of $R^1$, $R^2$ and $R^3$ is not hydrogen, more preferably wherein at least one of $R^1$, $R^2$ and $R^3$ is $-(C_2H_4—C_6H_{4-8})-OH$, still more preferably at least one of $R^1$, $R^2$ and $R^3$ is $-(C_2H_4—C_4H_8)OH$, most preferably at least one of $R^1$, $R^2$ and $R^3$ is $-(C_2H_4)-OH$, heterocyclic amines such as morpholine, imidazole, imidazoline, followed by subsequent reaction with a source of boron, preferably boric acid. By alkoxylated amine is meant that the alkoxylated amine can be a pure $C_2H_4$, $C_6H_2$, $C_4H_8$, $C_{10}H_{10}$ or $C_6H_{12}$ alkoxylated amine of a mixture of alkoxylated amines of two or more different carbon number alkyl groups. By normal or branched, preferably normal, $C_6$-$C_{24}$ saturated fatty acids is meant that the fatty acid can be a fatty acid containing only one carbon number group, e.g. $C_6$ or $C_{18}$ or $C_{24}$, or a mixture of fatty acids containing two or more different carbon number groups selected from the range of 6 to 24 carbons, preferably 7 to 17 carbons.

The ester moiety of the borated hydroxyl saturated hydrocarbyl ester amide-amine mixture is derived from an aliphatic alcohol, preferably a polyhydric alcohol, most preferably glycerol, boric acid and a saturated fatty acid having 6 to 24 carbon atoms. The fatty acids are the saturated fatty acids yielding saturated esters because unsaturated esters such as glycerol monooleate, glycerol dioleate and even their borated counterparts are not as effective due to their contributing to oxidative instability.

The production of the borated hydroxyl saturated hydrocarbyl ester amide-amine mixture is exemplified below by borated glyceride alkoxylated amide-amine, which comprises the reaction product of glycerol with saturated fatty acids containing from 6 to 24 carbon atoms to produce glycerol esters which are then amidated by reaction with the preferred ($C_2H_4—C_6H_{12}$), more preferably ($C_2H_4—C_4H_8$), most preferably ($C_2H_4$) alkoxylated amine, to form the alkoxylated amide product followed by boronation according to the following sequence:

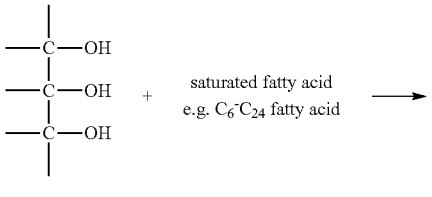

(A)

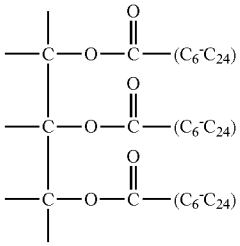

and (I)

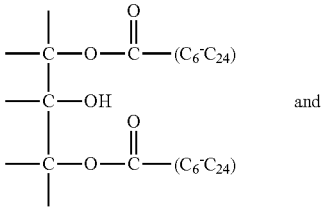

and (II)

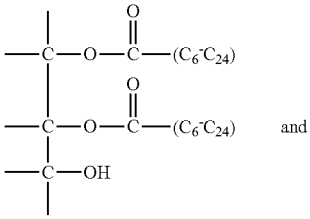

and (III)

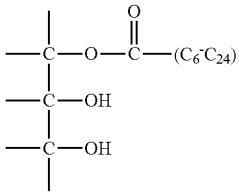

and unreacted A;

(IV)

unreacted A, (I), (II), (III), (IV)+

(B)

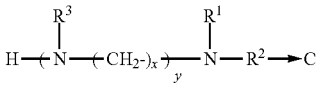

C being an intermediate product mixture, comprising unreacted A, I, II, III, IV and B and reaction product:

V

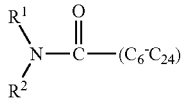

wherein y is zero and $R^1$ and $R^2$ are the same or different and in this particular description are selected from $-(C_2H_4-C_6H_{12})OH$, and hydrogen wherein at least one of $R^1$ and $R^2$ is $-(C_2H_4-C_6H_{12})OH$, more preferably at least one of $R^1$ and $R^2$ is $-(C_2H_4-C_4H_8)OH$, still more preferably at least one of $R^1$ and $R^2$ is $-(C_2-H_4)OH$.

A material representative of (V) is:

(VI)

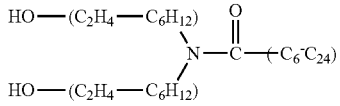

The entire intermediate product mixture C is then borated, preferably with boric acid to form the borate esters.

The borated esters resulting from the boronation of mixture C include by way of example and not limitation:

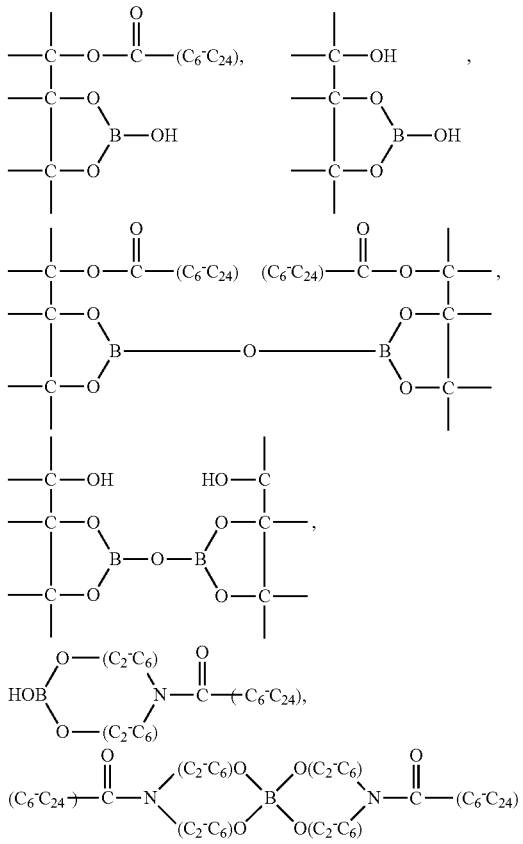

A preferred borated hydroxyl saturated hydrocarbyl ester amide-amine is the borated glycerol ester amide commercial material available from R. T. Vanderbilt Company as Vanlube® 289.

It is believed Vanlube® 289 exists as a mixture of materials including:

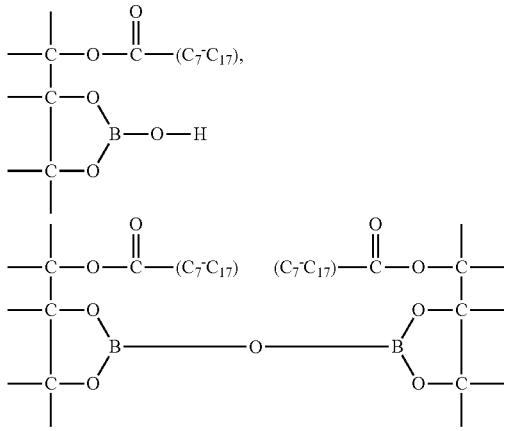

as well as unreacted glycerol, glycerol mono-, di- and tri-ester,

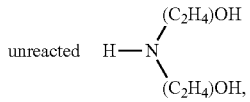

unreacted boronating agent and unboronated

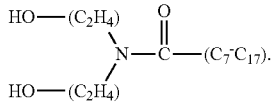

The unrefined, unseparated borated hydroxyl saturated hydrocarbyl ester amide-amine mixture is employed in an amount in the range of about 0.2 to 4.0 wt %, preferably about 0.4 to 3.0 wt %, contributing about 20 to 800 ppm boron to the formulated oil of and used in this invention.

The borated hydroxyl ester-amide-amine mixture is used in conjunction with zinc dialkyl dithiophosphate and alkali and/or alkaline earth metal salicylate detergent.

ZDDP compounds generally are of the formula:

$$Zn[SP(S)(OR^{I})(OR^{II})]_2$$

where $R^{I}$ and $R^{II}$ are straight or branched $C_1$ to $C_{18}$ alkyl groups, preferably $C_2$ to $C_{12}$ alkyl groups, more preferably $C_3$ to $C_{12}$ alkyl groups which may be either primary or secondary alkyl groups. ZDDP with mixed primary and secondary alkyl groups can also be employed. Primary alkyl group ZDDPs are known to possess better thermal oxidative stability than secondary alkyl group ZDDPs while secondary alkyl group ZDDPs can usually provide higher activity in reducing wear than primary alkyl group ZDDPs, so in order to balance both properties, a ZDDP having a mixture of primary alkyl groups and secondary alkyl groups is widely used and preferred.

It is known that ZDDPs decomposition patterns and rates are quite different for primary alkyl group ZDDPs versus secondary alkyl group ZDDPs. In addition, it is also known that the longer the chain length, the larger the molecule, and the less the activity. Therefore, the shorter chain lengths are also preferred.

The zinc dialkyl dithiophosphate (ZDDP) is employed in an amount in the range of 0.8 to 4.0 wt %, preferably 0.8 to 2.5 wt %, wherein the ZDDP contributes from about 120 to 500 ppm phosphorus, preferably about 150 to 480 ppm phosphorus, and from about 140 to 550 ppm zinc, preferably about 160 to 525 ppm zinc to the finished formulated oil used in the invention.

The detergent used is an alkali or alkaline earth metal salicylate detergent employed in an amount in the range of about 0.5 to 5.0 wt % based on active ingredient, preferably about 0.8 to 4.0 wt % based on active ingredient.

For the invention to achieve its desired goal of reducing one or more of deposits and friction, it is essential that the detergent used be an alkali or alkaline earth metal salicylate. Comparable formulations containing detergents other than the salicylate do not yield reductions in deposits or friction on the same scale as are unexpectedly secured when the detergent used is the salicylate.

The metal salicylate detergent is any low, medium or high TBN metal salicylate having a detergent Total Base Number of from 60 to 400, preferably 100 to 350, more preferably 200 to 300 mg KOH/g, or mixture of metal salicylate detergents of different TBN employed in an amount in the previously recited range of from about 0.5 to 5.0 wt % based on active ingredient sufficient to give the finished lubricating oil a TBN in the range of 3 to 10, preferably 4 to 9, more preferably 5 to 8 mg KOH/g.

The formulated lubricating oil useful in the present invention may additionally contain one or more of the other commonly used lubricating oil performance additives including but not limited to dispersants, other detergents, corrosion inhibitors, rust inhibitors, metal deactivators, other anti-wear agents and/or extreme pressure additives, anti-seizure agents, wax modifiers, viscosity index improvers, viscosity modifiers, fluid-loss additives, seal compatibility agents, other friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

The types and quantities of performance additives used in combination with the instant invention in lubricant compositions are not limited by the examples shown herein as illustrations.

Viscosity Improvers

Viscosity improvers (also known as Viscosity Index modifiers, and VI improvers) increase the viscosity of the oil composition at elevated temperatures which increases film thickness, while having limited effect on viscosity at low temperatures.

Suitable viscosity improvers include high molecular weight hydrocarbons, polyesters and viscosity index improver dispersants that function as both a viscosity index improver and a dispersant. Typical molecular weights of these polymers are between about 10,000 to 1,000,000, more typically about 20,000 to 500,000, and even more typically between about 50,000 and 200,000.

Examples of suitable viscosity improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

The amount of viscosity modifier may range from zero to 8 wt %, preferably zero to 4 wt %, more preferably zero to 2 wt % based on active ingredient and depending on the specific viscosity modifier used.

Antioxidants

Typical anti-oxidant include phenolic anti-oxidants, aminic anti-oxidants and oil-soluble copper complexes.

The phenolic antioxidants include sulfurized and non-sulfurized phenolic antioxidants. The terms "phenolic type" or "phenolic antioxidant" used herein includes compounds having one or more than one hydroxyl group bound to an aromatic ring which may itself be mononuclear, e.g., benzyl, or poly-nuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such bi-phenol compounds linked by alkylene bridges sulfuric bridges or oxygen bridges. Alkyl phenols include mono- and poly-alkyl or alkenyl phenols, the alkyl or alkenyl group containing from about 3-100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the phenolic anti-oxidant may be represented by the general formula:

$$(R)_x—Ar—(OH)_y$$

where Ar is selected from the group consisting of:

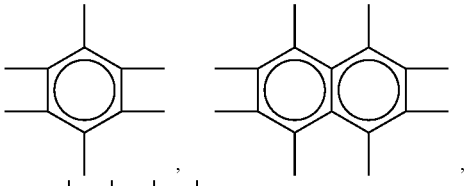

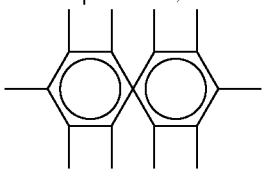

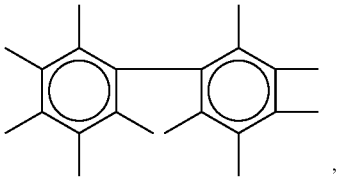

-continued

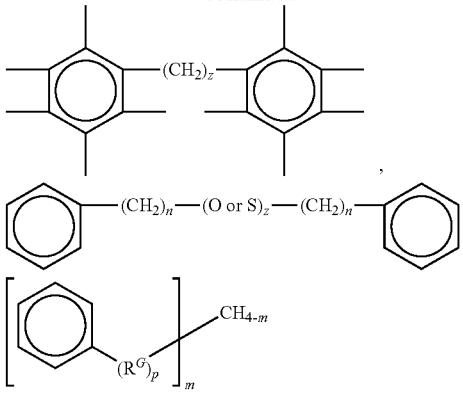

wherein R is a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^g$ is a $C_1$-$C_{100}$ alkylene or sulfur substituted alkylene group, preferably a $C_2$-$C_{50}$ alkylene or sulfur substituted alkylene group, more preferably a $C_2$-$C_2$ alkylene or sulfur substituted alkylene group, y is at least 1 to up to the available valences of Ar, x ranges from 0 to up to the available valances of Ar-y, z ranges from 1 to 10, n ranges from 0 to 20, and m is 0 to 4 and p is 0 or 1, preferably y ranges from 1 to 3, x ranges from 0 to 3, z ranges from 1 to 4 and n ranges from 0 to 5, and p is 0.

Preferred phenolic anti-oxidant compounds are the hindered phenolics and phenolic esters which contain a sterically hindered hydroxyl group, and these include those derivatives of dihydroxy aryl compounds in which the hydroxyl groups are in the o- or p-position to each other. Typical phenolic anti-oxidants include the hindered phenols substituted with $C_1$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4 methyl phenol; 2,6-di-t-butyl-4-ethyl phenol; and 2,6-di-t-butyl 4 alkoxy phenol; and

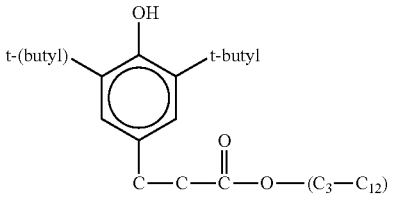

Phenolic type anti-oxidants are well known in the lubricating industry and commercial examples such as Ethanox® 4710, Irganox® 1076, Irganox® L1035, Irganox® 1010, Irganox® L109, Irganox® L118, Irganox® L135 and the like are familiar to those skilled in the art. The above is presented only by way of exemplification, not limitation on the type of phenolic anti-oxidants which can be used.

The phenolic anti-oxidant can be employed in an amount in the range of about 0.1 to 3 wt %, preferably about 1 to 3 wt %, more preferably 1.5 to 3 wt % on an active ingredient basis.

Aromatic amine anti-oxidants include phenyl-α-naphthyl amine which is described by the following molecular structure:

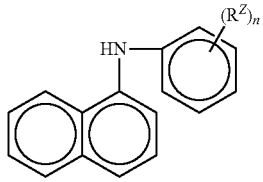

wherein $R^z$ is hydrogen or a $C_1$ to $C_{14}$ linear or $C_3$ to $C_{14}$ branched alkyl group, preferably $C_1$ to $C_{10}$ linear or $C_3$ to $C_{10}$ branched alkyl group, more preferably linear or branched $C_6$ to $C_8$ and n is an integer ranging from 1 to 5 preferably 1. A particular example is Irganox L06.

Other aromatic amine anti-oxidants include other alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines anti-oxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of such other additional amine anti-oxidants which may be present include diphenylamines, phenothiazines, imidodibenzyls and diphenyl phenylene diamines. Mixtures of two or more of such other additional aromatic amines may also be present. Polymeric amine antioxidants can also be used.

Another class of anti-oxidant used in lubricating oil compositions and which may also be present are oil-soluble copper compounds. Any oil-soluble suitable copper compound may be blended into the lubricating oil. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Such anti-oxidants may be used individually or as mixtures of one or more types of anti-oxidants, the total amount employed being an amount of about 0.50 to 5 wt %, preferably about 0.75 to 3 wt % (on an as-received basis).

Detergents

In addition to the alkali or alkaline earth metal salicylate detergent which is an essential component in the present invention, other detergents may also be present. While such other detergents can be present, it is preferred that the amount employed be such as to not interfere with the synergistic effect attributable to the presence of the salicylate. Therefore, most preferably such other detergents are not employed.

If such additional detergents are present, they can include alkali and alkaline earth metal phenates, sulfonates, carboxylates, phosphonates and mixtures thereof. These supplemental detergents can have total base number (TBN) ranging from neutral to highly overbased, i.e. TBN of 0 to over 500, preferably 2 to 400, more preferably 5 to 300, and they can be present either individually or in combination with each other in an amount in the range of from 0 to 10 wt %, preferably 0.5 to 5 wt % (active ingredient) based on the total weight of the formulated lubricating oil. As previously stated, however, it is preferred that such other detergent not be present in the formulation.

Such additional other detergents include by way of example and not limitation calcium phenates, calcium sulfonates, magnesium phenates, magnesium sulfonates and other related components (including borated detergents).

Dispersant

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines Molar ratios can vary depending on the amine or polyamine. For example, the molar ratio of alkenyl succinic anhydride to TEPA can vary from about 1:1 to about 5:1.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines.

For example, suitable alkanol amines include ethoxylated polyalkylpolyamines, propoxylated polyalkylpolyamines and polyalkenylpolyamines such as polyethylene polyamines. One example is propoxylated hexamethylenediamine.

The molecular weight of the alkenyl succinic anhydrides will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. Process aids and catalysts, such as oleic acid and sulfonic acids, can also be part of the reaction mixture. Molecular weights of the alkylphenols range from 800 to 2,500.

Typical high molecular weight aliphatic acid modified Mannich condensation products can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamine reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %, more preferably about 1 to 6 wt % (on an as-received basis) based on the weight of the total lubricant.

Pour Point Depressants

Conventional pour point depressants (also known as lube oil flow improvers) may also be present. Pour point depressant may be added to lower the minimum temperature at which the fluid will flow or can be poured. Examples of suitable pour point depressants include alkylated naphthalenes polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. Such additives may be used in amount of about 0.0 to 0.5 wt %, preferably about 0 to 0.3 wt %, more preferably about 0.001 to 0.1 wt % on an as-received basis.

Corrosion Inhibitors/Metal Deactivators

Corrosion inhibitors are used to reduce the degradation of metallic parts that are in contact with the lubricating oil composition. Suitable corrosion inhibitors include aryl thiazines, alkyl substituted dimercapto thiodiazoles thiadiazoles and mixtures thereof. Such additives may be used in an amount of about 0.01 to 5 wt %, preferably about 0.01 to 1.5 wt %, more preferably about 0.01 to 0.2 wt %, still more preferably about 0.01 to 0.1 wt % (on an as-received basis) based on the total weight of the lubricating oil composition.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride and sulfolane-type seal swell agents such as Lubrizol 730-type seal swell additives. Such additives may be used in an amount of about 0.01 to 3 wt %, preferably about 0.01 to 2 wt % on an as-received basis.

Anti-Foam Agents

Anti-foam agents may advantageously be added to lubricant compositions. These agents retard the formation of stable foams. Silicones and organic polymers are typical antifoam agents. For example, polysiloxanes, such as silicon oil or polydimethyl siloxane, provide antifoam properties. Antifoam agents are commercially available and may be used in conventional minor amounts along with other additives such as demulsifiers; usually the amount of these additives combined is less than 1 percent, preferably 0.001 to about 0.5 wt %, more preferably about 0.001 to about 0.2 wt %, still more preferably about 0.0001 to 0.15 wt % (on an as-received basis) based on the total weight of the lubricating oil composition.

Inhibitors and Antirust Additives

Anti-rust additives (or corrosion inhibitors) are additives that protect lubricated metal surfaces against chemical attack by water or other contaminants. One type of anti-rust additive is a polar compound that wets the metal surface preferentially, protecting it with a film of oil. Another type of anti-rust additive absorbs water by incorporating it in a water-in-oil emulsion so that only the oil touches the surface. Yet another type of anti-rust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 wt %, preferably about 0.01 to 1.5 wt % on an as-received basis.

In addition to the ZDDP anti-wear additives which are essential components of the present invention, other anti-wear additives can be present, including zinc dithiocarbamates, molybdenum dialkyldithiophosphates, molybdenum dithiocarbamates, other organo molybdenum-nitrogen complexes, sulfurized olefins, etc.

The term "organo molybdenum-nitrogen complexes" embraces the organo molybdenum-nitrogen complexes described in U.S. Pat. No. 4,889,647. The complexes are reaction products of a fatty oil, dithanolamine and a molybdenum source. Specific chemical structures have not been assigned to the complexes. U.S. Pat. No. 4,889,647 reports an infrared spectrum for a typical reaction product of that invention; the spectrum identifies an ester carbonyl band at 1740 $cm^{-1}$ and an amide carbonyl band at 1620 $cm^{-1}$. The fatty oils are glyceryl esters of higher fatty acids containing at least 12 carbon atoms up to 22 carbon atoms or more. The molybdenum source is an oxygen-containing compound such as ammonium molybdates, molybdenum oxides and mixtures.

Other organo molybdenum complexes which can be used in the present invention are tri-nuclear molybdenum-sulfur compounds described in EP 1 040 115 and WO 99/31113 and the molybdenum complexes described in U.S. Pat. No. 4,978,464.

EXAMPLES AND COMPARATIVE EXAMPLES

Six different lubricant formulations are presented in Table 1. The formulations are compositionally generally similar but differing where indicated in the amount of metal salicylate detergent employed and also in whether a friction modifier is present or not and, if present, the type employed.

Entries 1, 2 and 3 are one set of oils based on 1.2 wt % calcium salicylate detergents (as-received, about 50% active ingredient) and 0.45 wt % ZDDP (as-received) which provide a set of three engine oils all with about 0.46 to 0.495 ash and a TBN<4. The TBN of the detergent was about 200 mg KOH/g. The ZDDP was all secondary $C_3$ to $C_6$ alkyl group ZDDP.

Entry 1 is a reference oil example which contained no friction modifier.

Entry 2 is an Example of the present invention.

Entry 3 is a Comparative Example.

Entry 2 uses a borated saturated short chain ester-amide-amine friction reducer (Vanlube® 289) and Entry 3 uses an unsaturated glycerol mixed oleate (mono-, di- and tri-oleate with Glycerol Mono-oleate (GMO) being the majority) type friction reducer (Lubrizol 8650).

Entries 4, 5 and 6 are another set of oils based on 3% calcium salicylate detergents (as-received, about 50% active ingredient) and 0.45% ZDDP (as-received) which provide a set of three engine oils all with about 0.85 to 0.89% ash and a TBN<9. The calcium salicylate detergent and the ZDDP employed in Entries 4, 5 and 6 are the same as used in Entries 1, 2 and 3.

Entry 4 is a reference oil example which contained no friction modifier.

Entry 5 is an Example of the present invention.

Entry 6 is a Comparative Example.

Entry 5 used the same borated saturated short chain ester-amide-amine friction reducer (Vanlube® 289) as Entry 2, and Entry 6 used the same unsaturated GMO-type friction reducer (Lubrizol 8650) as Entry 3.

Entry 2 and Entry 3 have almost identical physical properties and both have excellent friction property as evidenced by low coefficient of friction as compared to Entry 1. The Four-ball EP (ASTM D-2783 method) performances are comparable for both Entry 2 and 3. Entry 2 has slightly better Four-ball wear performance than that of Entry 3. However, the PDSC tests (isothermal and ramping) demonstrate the huge difference in oxidative stability.

The ASTM D6186 PDSC method is an isothermal method that keeps the oil at a constant, elevated temperature and monitors the oil degradation by observing the change of thermal behavior called oil induction time. The longer the oil induction time, the better the ability of the oil to resist thermal and oxidative degradation. The typical ASTM test conditions are 500+/−25 psig oxygen pressure, 3.0+/−0.2 mg sample size and a fixed test temperature selected from 155, 180 and 210° C. The results reported in Table 1 are for an isothermal PDSC method, in which less pressure (105 psig oxygen), smaller sample size (6.5+/−0.3 mg) and higher isothermal temperature (220° C.) were employed. Another method called ramp method was also employed, where the test oil is subject to oxidation by ramping up the test temperature at a fixed rate from low temperature to an elevated temperature and monitoring the oil induction temperature at which oxidation occurs. The ramping speed used was 10° C. per minute, the sample size was 6.5+/−0.3 mg, pressure was 105 psi $O_2$, and the highest temperature was 350° C. where the ramping process was stopped upon reaching that temperature. The higher the oil induction temperature, the better the ability of the oil to resist thermal and oxidative degradation.

In the ramping PDSC, Entry 2 has about 3.7° C. higher onset temperature than Entry 3. Also, in the isothermal PDSC (@220° C.), Entry 2 has about 13.3 minutes longer onset time. In general, oxidation rates double with about 10° C. increase in temperature. Therefore, these results can be translated into about 34% to 38% improvement in terms of control of viscosity or acid number increases or any other comparable measurements for control of oxidation, for the Example (Entry 2) versus the Comparative Example (Entry 3).

Similarly, Entry 5 has about 10° C. higher onset temperature and 17.5 minutes longer onset time than Entry 6. These results can also be translated into about 46% to 100% improvement in terms of control of viscosity or acid number increases or any other comparable measurements for control of oxidation. The Four-ball EP results of Entry 6 are significantly poorer than Entry 5 and the weaknesses may be primarily due to the poorer oxidative stability of the GMO used as friction modifier.

TABLE 1

| | Entry | | | | | |
|---|---|---|---|---|---|---|
| | 1 | 2 | 3 | 4 | 5 | 6 |
| | Engine Oil (0.0% P) | | | | | |
| | Reference Oil | Example | Comparative Example | Reference Oil | Example | Comparative Example |
| EO-A Partial Formulation(1) | 98.55% EO-A | 97.35% EO-A | 97.35% EO-A | 96.55% EO-A | 95.55% EO-A | 95.55% EO-A |
| ZDDP | 0.45% | 0.45% | 0.45% | 0.45% | 0.45% | 0.45% |

TABLE 1-continued

| | | Entry | | | | | |
|---|---|---|---|---|---|---|---|
| | | 1 | 2 | 3 | 4 | 5 | 6 |
| | | Engine Oil (0.0% P) | | | | | |
| | | Reference Oil | Example | Comparative Example | Reference Oil | Example | Comparative Example |
| Detergent | | 1.2% salicylates | 1.2% salicylates | 1.2% salicylates | 3% salicylates | 3% salicylates | 3% salicylates |
| Friction Modifier | | | 1 % borated saturated ester/amide (Vanlube ® 289) | 1% GMO (LZ8650) | | 1% borated saturated ester/amide (Vanlube ® 289) | 1% GMO (LZ8650) |
| Low Phosphorus | | (0.045% P) | (0.045% P) | (0.045% P) | (0.045% P) | (0.045% P) | (0.045% P) |
| Solubility Appearance | | clear & bright | clear & bright | clear & bright | clear & bright | clear & bright | clear & bright |
| 4 Ball Wear | Wear Scar Diameter (mm) | 0.46 | 0.50 | 0.60 | 0.48 | 0.40 | 0.52 |
| 40 kg/1200 rpm/ 60 min/200° F.) | K Factor (×10E−8) | 1.27 | 2.02 | 4.66 | 1.71 | 0.61 | 2.36 |
| 4 Ball EP (D2783) | Last Nonseizure Load (Kg) | 100 | 100 | 100 | 100 | 100 | 80.0 |
| 30° C./10 sec/ 1760 rpm) | Load Wear Index | 42.3 | 42.3 | 43.1 | 41.1 | 41.3 | 35.7 |
| PDSC (Ramping) | Onset T (° C.) | 264.7 | 271.5 | 267.8 | 260.8 | 270.8 | 260.8 |
| PDSC (Isothermal) | Onset Time (min) | 38.7 | 52.2 | 38.9 | 49.1 | 55.3 | 37.8 |
| HFRR Dyno - ramping @ 2° C./min for 82 min (end temperature, 195° C.) | Ave. Friction | 0.14 | 0.11 | 0.11 | 0.13 | 0.11 | 0.11 |
| D2896 | TBN | 3.96 | 3.5 | 3.1 | 8.19 | 8.7 | 8.5 |
| D874 (wt %) | Sulfated Ash | 0.46 | 0.48 | 0.49 | 0.89 | 0.88 | 0.85 |
| D6443 (wt %) | Phosphorus | 0.0459 | 0.0467 | 0.0475 | 0.0463 | 0.046 | 0.0469 |
| D6443 (wt %) | Zinc | 0.0499 | 0.0514 | 0.052 | 0.0499 | 0.0506 | 0.0513 |
| D6443 (wt %) | Calcium | 0.0888 | 0.0931 | 0.0937 | 0.2189 | 0.2204 | 0.2218 |
| D6443 (wt %) | Magnesium | <0.002 | <0.002 | <0.002 | 0.0059 | <0.002 | <0.002 |
| D6443 (wt %) | Copper | <0.002 | <0.002 | <0.002 | <0.002 | <0.002 | <0.002 |
| D6443 (wt %) | Chlorine | <0.002 | <0.002 | <0.002 | <0.002 | <0.002 | <0.002 |
| D6443 (wt %) | Sulfur | 0.1339 | 0.1288 | 0.13 | 0.1405 | 0.1301 | 0.1318 |

(1)EO-A partial formulation contains hydroprocessed base oil plus ashless antioxidants, defoamants, ashless dispersants and viscosity modifiers.

As demonstrated in Table 1, by adding 1% Vanlube® 289 friction reducer to a ZDDP-containing engine oil, the low frictional property (low coefficient of friction) can be maintained throughout a wide temperature range (from ambient temperature up to 195° C.) as shown in the High Frequency Reciprocating Rig (HFRR) Dyno test, and is consistently lower than the coefficient friction of an oil formulation containing only ZDDP, see FIG. 1 comparing Entries 4 and 5. The HFRR test is an industry popular bench friction test available from PCS Corporation. The method used for the data reported in Tables 1 and 3 was modified in-house, to employ a ramping speed of 2° C./min for times sufficient to raise the temperature from about 30-31° C. to an end temperature of either 150° C. or 195° C. as indicated on the respective tables. As illustrated in Table 2 below, two almost identical engine oil formulations (A & B) are used for comparison. Both oil A and oil B are low ash and low phosphorus engine oils (0.045% phosphorus). Oil A contains 0.5% of a fully saturated organic ashless friction modifier, Perfad 3336, and oil B contains 2.2% of a fully saturated borated organic friction modifier, Vanlube® 289. Although both additives are saturated friction reducers with good thermal and oxidative stability, oil B provides significantly lower deposit in the critical Thermo-Oxidation Engine Oil Simulation Test (TEOST) deposit test (ASTM D6335) than oil A, indicating that oil B has much better deposit control and oxidative stability. 200 TBN calcium salicylate detergent used at 3 wt % (about 50% active ingredient) in each formulation brings the base number of the lubricating oils A and B to 6. Formulations A and B are almost identical except one uses PERFAD 3336 and the other one uses Vanlube® 289. Both oils are formulated with the same amounts of ashless dispersants, ashless antioxidants, ZDDP, viscosity modifiers, defoamant and synthetic base oil system. Clearly, both oils have low deposits, however the one with Vanlube 289 exhibits extraordinarily lower deposits than the other.

TABLE 2

| Engine Oil Formulation | A | B |
|---|---|---|
| P, % | 0.045 | 0.045 |
| Vanlube ® 289 | 0 | 2.2 |
| PERFAD 3336 | 0.5 | 0 |
| D6335 Deposits, mg | 11.2 | 1.9 |

PERFAD 3336 is an oxidatively stable ashless friction modifier marketed by Croda, Inc. Its chemistry is based on ester and is believed to be a mixture of mono-, di- and tri-ester of glycerin and is unborated, but fully saturated. Thus, Vanlube 289 is a saturated, borated ester-amide while PERFAD 3336 is a saturated, non-borated ester.

In Table 3 it is shown that the choice of detergent is critical and essential to the practice of the present invention.

In the Examples and Comparative Examples, the lubricating oil formulation was kept constant in terms of base oil, dispersant-inhibitor-viscosity modifier system, secondary alkyl group ZDDP and Vanlube® 289, the formulations differing only in the nature of the detergent present.

as Model MTM. The test specimens and apparatus configuration are such that realistic pressure, temperature and speed can be attained without requiring very large loads, motors or structures. A small sample of fluid (50 ml) is placed in a test cell and the machine automatically runs either through a range of speeds, slide-to-roll ratios, temperatures and loads, or at specifically set temperature, slide-to-roll ratio and speed range to generate information regarding the friction performance of a test fluid without further operator intervention. The working of the MTM is known and familiar to those of skill in the art.

TABLE 3

| | Constant Ash Series | | | Constant TBN Series | | |
|---|---|---|---|---|---|---|
| | Engine Oil Formulation (wt %) | | | | | |
| | Example | Comparative Example | Comparative Example | Example | Comparative Example | Comparative Example |
| Dispersant-Inhibitor-VM System | 17.1 | 17.1 | 17.1 | 17.1 | 17.1 | 17.1 |
| Group IV/B Base Oil plus Detergent | 80.7 | 80.7 | 80.7 | 80.7 | 80.7 | 80.7 |
| Saturated, Borated Ester/Amide/Amine | 2.2 | 2.2 | 2.2 | 2.2 | 2.2 | 2.2 |
| Overbased Detergent Type | Calcium Salicylate TBN 200 | Calcium Sulfonate TBN 300 | Calcium Phenate TBN 255 | Calcium Salicylate TBN 200 | Calcium Sulfonate TBN 300 | Calcium Phenate TBN 255 |
| Amount (as-received) | 3 wt % (~50% active ingredient) | 1.9 wt % (~60% active ingredient) | 2.36 wt % (~67% active ingredient) | 3 wt % (~50% active ingredient) | 2.0 wt % (~60% active ingredient) | 2.43 wt % (~67% active ingredient) |
| Formulated Oil TBN | 6.16 | — | — | 6.16 | 6.16 | 6.16 |
| Detergent Ash (wt %), ASTM D874 | 0.75 | 0.75 | 0.75 | 0.75 | — | — |
| TEOST 33C (Deposit test), mg | 1.9 | 6.8 | 4.7 | 1.9 | 5.2 | 10.6 |
| MTM Friction (50° C., 10 mm/s, 0.5 slide/roll ratio) | 0.076 | 0.097 | 0.077 | 0.076 | 0.090 | 0.101 |
| MTM Friction (100° C., 10 mm/s, 0.5 slide/roll ratio) | 0.088 | 0.116 | 0.104 | 0.088 | 0.106 | 0.112 |
| HFRR Friction end temperature 150° C. | 0.097 | 0.125 | 0.118 | 0.097 | 0.117 | 0.115 |

The oils evaluated were all low SAP oils which have 0.045 wt % Phosphorus, ~0.75 wt % ash and 6-7 TBN.

As demonstrated in Table 3, the formulation containing the calcium salicylate detergent outperformed similar formulations identical in all respects except for employing calcium sulfonate or calcium phenate instead of calcium salicylate, in terms of TEOST deposits, Mini Traction Machine (MTM) friction (under both MTM test conditions), and HFRR friction.

The Mini Traction Machine (MTM) is a fully automated instrument manufactured by PCS Instruments and identified

What is claimed is:

1. A method for improving one or more of the deposit formation or friction in an engine lubricated with a lubricating oil by using as the lubricating oil a formulated oil comprising a Group IV lubricating oil base stock at greater than or equal to 77.7 wt. % and additive amounts of an essential component: (1) a borated hydroxyl saturated hydrocarbon ester amide-amine mixture comprising Vanlube® 289 which is a mixture of materials including:

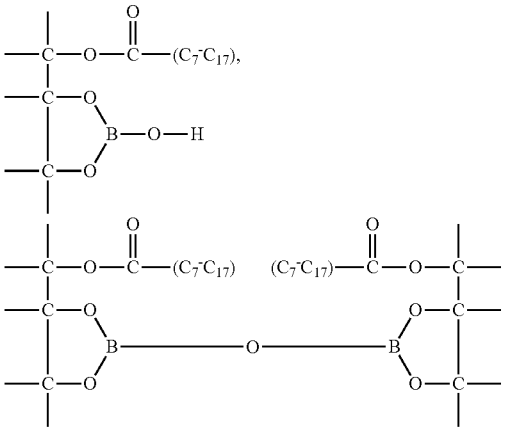

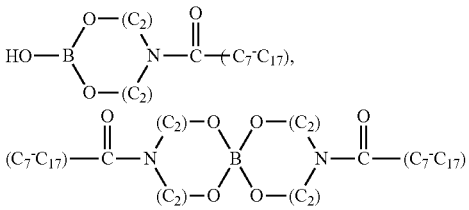

as well as unreacted glycerol, glycerol mono-, di- and tri-ester,

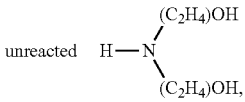

unreacted boronating agent and unboronated

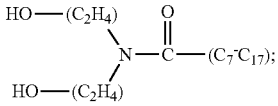

(2) zinc dialkyl dithiophosphate; and (3) calcium salicylate detergent whereby the levels of deposit formation and/or of friction are improved as compared to the levels achieved using a Group IV lubricating oil containing the borated hydroxyl ester amide-amine mixture, the zinc dialkyl dithiophosphate and a calcium phenate or calcium sulfonate detergent, wherein the borated hydroxyl saturated hydrocarbyl ester amide-amine mixture is employed in an amount in the range of 1.0 to 2.2 wt %, wherein the zinc dialkyl dithiophosphate is of the formula:

$Zn[SP(S)(OR' \text{ and } R'')]_2$ wherein R' and R" are straight or branched secondary $C_1$ to $C_{18}$ alkyl groups, present in an amount of about 0.45 wt % to contribute about 460 to 467 ppm phosphorous to the formulated oil, and wherein the calcium salicylate has a TBN of about 200 mg KOH/g present in an amount in the range 1.2 to 3 wt %, wherein the deposit formation as measured by TEOST 33C (ASTM D6335) is substantially lower than the levels achieved using a Group IV lubricating oil not containing the borated hydroxyl ester amide-amine mixture, the zinc dialkyl dithiophosphate and the calcium phenate or calcium sulfonate detergent.

2. The method of claim 1 wherein the borated hydroxyl saturated hydrocarbyl ester amide-amine mixture comprises the unseparated/unpurified product produced by reacting an ester derived from an alcohol selected from aliphatic alcohols and polyhydric alcohols with a saturated fatty acid having 6 to 24 carbon atoms, the ester being reacted with a basic amine and a borating agent.

3. The method of claim 2 wherein the alcohol is glycerol.

4. The method of claim 2 wherein the saturated fatty acid has 6 to 18 carbon atoms.

5. The method of claim 2 wherein the basic amine is selected from the group consisting of amines of the formula:

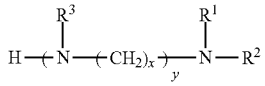

wherein x is an integer ranging from 1 to 10, y is an integer ranging from 0 to 10, $R^1$, $R^2$ and $R^3$ are the same or different and are selected from H, $C_1$ to $C_{30}$ alkyl, $-(C_2H_4—C_6H_{4-12})OH$, provided at least one of $R^1$, $R^2$ and $R^3$ is not hydrogen, and heterocyclic amines.

6. The method of claim 2 wherein the borating agent is boric acid.

7. The method of claim 2 wherein the alcohol is glycerin, the saturated fatty acid contains 7 to 17 carbon atoms, the amine is of the formula:

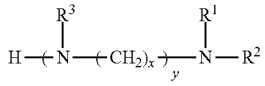

wherein y is zero, $R^1$ and $R^2$ are the same or different and are selected from H and $(C_2H_4—C_6H_{12})OH$, provided at least one of $R^1$ and $R^2$ is $-(C_2H_4—C_6H_{4-12})OH$, and the borating agent is boric acid.

8. The method of claim 7 wherein $R^1$ and $R^2$ are the same or different and are selected from H and $(C_2H_4)OH$, provided at least one of $R^1$ and $R^2$ is $-(C_2H_4)OH$.

9. The method of claim 7 wherein both $R^1$ and $R^2$ are $C_2H_4)OH$.

* * * * *